United States Patent [19]

Pinsonneault

[11] Patent Number: 4,834,129

[45] Date of Patent: May 30, 1989

[54] TENT STRUCTURES FOR COVERING FREE-STANDING EQUIPMENT

[75] Inventor: Jean P. Pinsonneault, Brossard, Canada

[73] Assignee: Northern Telecom Limited, Montreal, Canada

[21] Appl. No.: 94,209

[22] Filed: Sep. 8, 1987

[51] Int. Cl.[4] ..... E04H 15/04

[52] U.S. Cl. ..... 135/90; 135/107; 135/109

[58] Field of Search ..... 135/90, 106, 107, 109, 135/112

[56] References Cited

U.S. PATENT DOCUMENTS

| | | | |
|---|---|---|---|
| 1,752,571 | 4/1930 | Olson | 135/109 |
| 1,803,237 | 4/1931 | Crooke | 135/90 |
| 2,528,721 | 11/1950 | Brockman et al. | 135/109 |

FOREIGN PATENT DOCUMENTS

| | | | |
|---|---|---|---|
| 265047 | 9/1968 | Austria | 135/107 |

*Primary Examiner*—David A. Scherbel
*Assistant Examiner*—Caroline D. Dennison
*Attorney, Agent, or Firm*—R. J. Austin

[57] ABSTRACT

A tent structure to cover free-standing equipment and adjacent work area. It has a base frame with a securing device to enable the base frame to be secured to the equipment. The base frame carries a tent shroud support frame which with the base frame secured to the equipment, is movable between a collapsed condition and a tent shroud support condition. Ideally, the base frame is planar and the whole tent structure is planar when collapsed and the collapsed support frame preferably lies within the boundary of the base frame.

7 Claims, 5 Drawing Sheets

TENT STRUCTURES FOR COVERING FREE-STANDING EQUIPMENT

This invention relates to tent structures for covering free-standing equipment and adjacent work areas. In the electrical or electronic industries, it is common practice to locate free-standing equipment in the open air. Normally, as in the case of telecommunications equipment, the equipment includes a surrounding cabinet to protect it from ambient weather conditions. It is of course necessary, from time-to-time, for engineers to service such equipment. Clearly, servicing of the equipment must take place not-withstanding weather conditions. Apart from protecting the maintenance engineer from the effects of bad weather, the functional part of the equipment needs protection when the cabinet doors are open for extended periods during maintenance procedure. Conventionally, equipment and the maintenance engineer are protected by a tent structure which is free-standing and which is assembled close to the equipment. This free-standing tent is then positioned over the cabinet and a work area in front of the cabinet in which the maintenance engineer is to stand. Obviously, the use of such tents is mainly necessary during adverse weather conditions. However, it is during such conditions that the assembly and movement of the tent over the cabinet is a most difficult procedure to follow. For instance, such tents are usually employed during windy and rainy conditions which makes their controlled maneuverability by a single person a very difficult proposition. The difficulty in assembling and moving the tent over the cabinet is not only an extremely tiring procedure under adverse weather conditions but it is also extremely time consuming.

The present invention provides a tent structure which in use seeks to overcome or lessen the above disadvantages.

According to the present invention there is provided a tent structure for covering free-standing equipment and an adjacent work area, the structure comprising a base frame having means by which it may be secured to the free-standing equipment, the base frame carrying a tent shroud support frame which, in a secured condition of the base frame to free-standing equipment, is movable between a collapsed condition on the base frame and an extended tent shroud supporting condition.

As can be seen, a tent structure according to the present invention is secured into position upon the free-standing equipment before the structure is expanded and covered with the tent shroud. Because of this method of operation, the collapsed weight of the structure is securely held and does not need to be controlled as the support frame is moved into its support condition. Hence, with the collapsed tent structure secured in its operating position, the engineer may easily and quickly extend the support frame and place the tent shroud around it in adverse wind conditions, while the effects of the unwieldiness of the structure are minimized.

The tent structure according to the invention is easily transportable manually in its collapsed condition and to help in this regard, in a preferred construction, the base frame is substantially planar. Conveniently, the support frame in a collapsed condition lies at one side of the base frame whereby the total tent structure is also substantially planar which adds to the ease of manual movement. To ensure that the tent structure in its collapsed condition is as small as possible to assist the engineer to move it to its position upon the free-standing equipment, the support frame should lie, in its collapsed condition, within the confines of the base frame in a plan view taken onto the plane of the base frame.

One embodiment of the invention will now be described, by way of example, with reference to the accompanying drawings, in which:

FIGS. 11 and 12 are front and side elevational views respectively of the completed tent surrounding the free-standing electronics equipment; and FIG. 13 is a view similar to FIG. 7 showing the collapsed condition of the assembled tent structure and shroud assembly.

Figure 1:
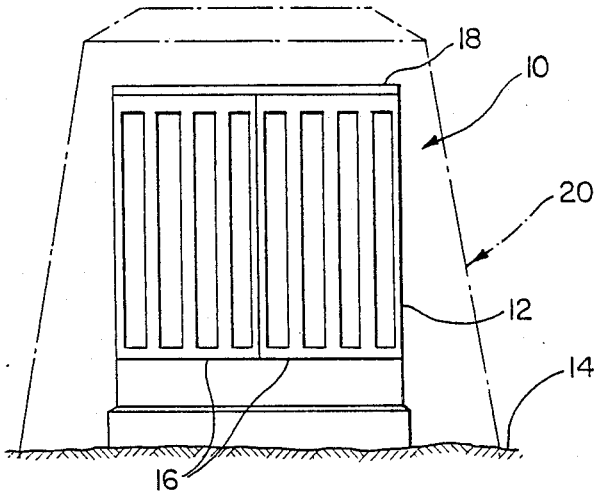
FIG. 1 PRIOR ART
FIG. 1 is a front elevational view of free-standing electronics equipment for use in the telecommunications field.

As shown by FIG. 1, a free-standing item of telecommunications equipment 10 comprises a cabinet 12 secured to the ground 14, the cabinet housing functional parts of the equipment. The cabinet is provided with two access doors 16 at its front and a flat top 18 which overhangs the doors 16 at the front, as will be later described.

Figure 2:
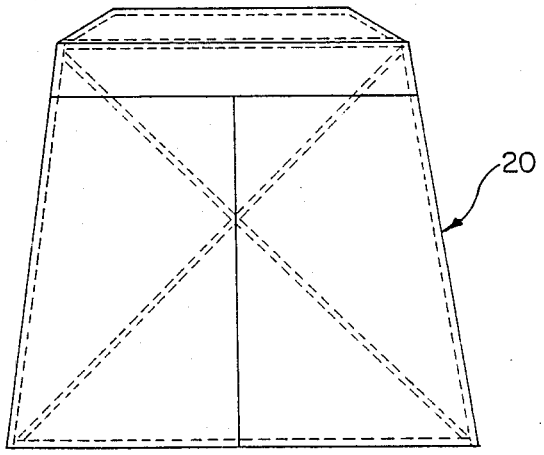
FIG. 2 PRIOR ART
FIG. 2 is a front elevational view of a typical prior art tent assembled for use with the equipment in FIG. 1.

For maintenance purposes in the field, a collapsible tent 20 is provided for positioning over the equipment 10 and for covering a work area immediately in front of the doors 16. This tent structure is to provide protection for the equipment when the doors 16 are open during maintenance procedures, and also to a maintenance engineer working on the equipment. In use of this prior tent 20, it is necessary for the tent to be pre-assembled, as shown in FIG. 2, and then to be lifted by the maintenance engineer, possibly working alone, so as to be positioned over the top of and around the cabinet, as shown in chain-dotted outline in FIG. 1, before maintenance can proceed. Apart from the bulky nature of the completed tent shown in FIG. 2, it may be extremely difficult to position over the cabinet in windy conditions, especially when being controlled by only one person. It will be realized that the assembly of the tent and its location into its working position may be both lengthy and tedious and also arduous dependent upon weather conditions.

The present invention provides a tent structure which minimizes all of the above problems.

Figure 3:
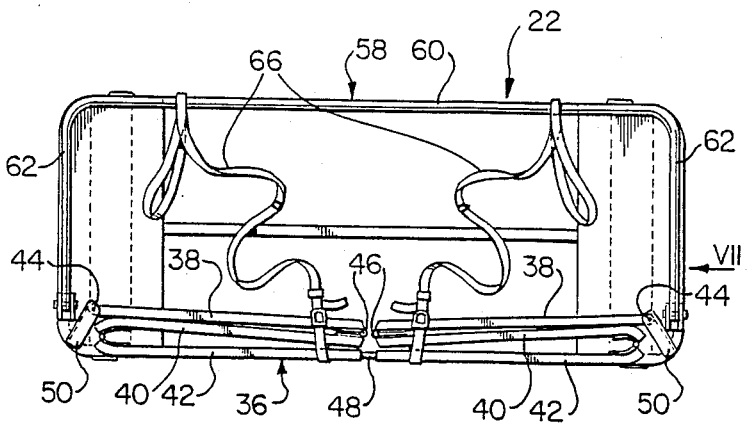
FIG. 3 is a plan view of a tent structure according to the embodiment in a collapsed condition.
Figure 4:
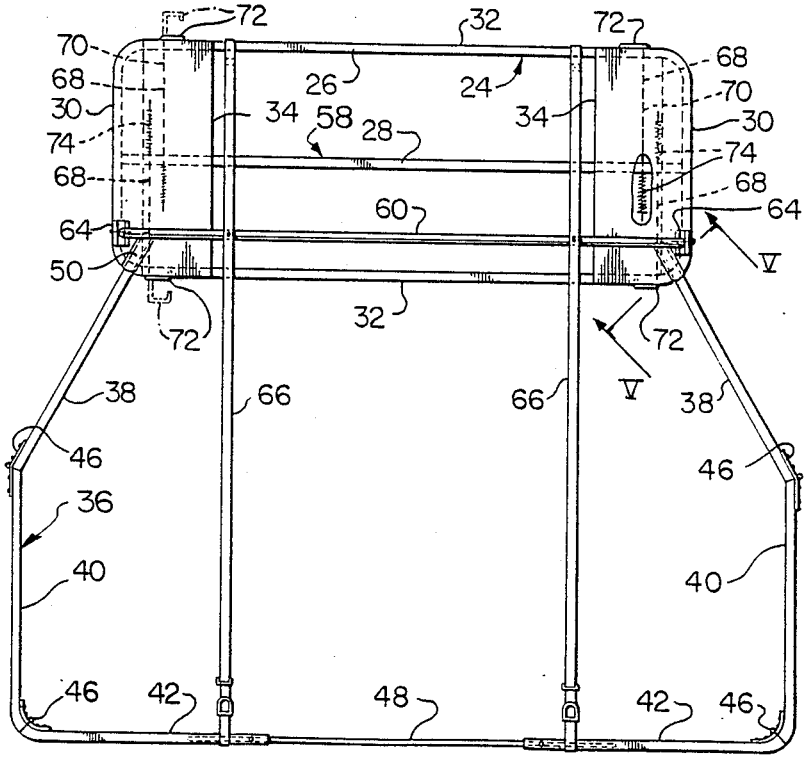
FIG. 4 is a view similar to FIG. 3 and showing the structure in an expanded condition.

As shown in the embodiment in FIGS. 3 and 4, a tent structure 22 comprises a base frame 24. The base frame is generally of rectangular construction in plan view (FIG. 4) and is substantially planar in side elevation. This frame is formed with an edge member which is a square section tube 26, and a strengthening tube 28 extends the full length of the frame to be welded or riveted to the tube 26 at the two ends 30 at a position midway between the sides 32 of the base frame. For a short distance inwardly from each end 30 of the frame 24, the sides of the frame are covered by two metal sheets 34 which sandwich the tubes 26 and 28 between them. The tubes 26 and 28 and plates 34 are formed from aluminum so as to minimize the weight of the structure. The tent structure also includes a tent shroud support frame. The support frame comprises a first portion 36 which comprises two end regions each formed basically by three arms 38, 40 and 42 which are pivotally connected together in series with one another at their ends. The two arms 38 which lie at remote ends of the first portion 36 of the frame are pivotally mounted by their remote ends to the base frame at positions 44, shown clearly in FIG. 3. Adjacent ends of arms 38 and 40 and arms 40 and 42 are pivotally connected together by hinges 46. These hinges allow for pivotal movement of the arms at each end of the first portion 36 so that the first portion may lie in a collapsed condition, as shown in FIG. 3, in which the arms at each end lie substantially side-by-side, and a tent shroud supporting condition, as shown in FIG. 4. All of the tubes 38, 40 and 42 are of square cross-section similar to tubes 26 and 28. Between the two tubes 42 is located an intermediate region of the first portion of the support frame, this intermediate region provided by a circular section tube 48 which is telescopically received within each of the arms 42. To assume the tent shroud supporting position, the first portion 36 is expanded (FIG. 4) so that the arms of the end regions extend outwardly beyond the boundary of the base frame in plan view. As the arms move outwardly to the position of FIG. 4, the tube 48 slides outwardly from the arms 42 so that adjacent ends of the arms move further apart (compare FIGS. 3 and 4).

Figure 5:
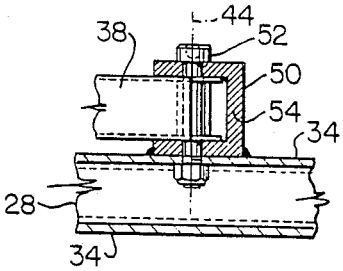
FIG. 5 is a cross-sectional view taken along line V—V in FIG. 4 and to a larger scale.
Figure 6:
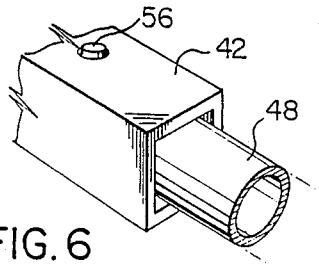
FIG. 6 is an isometric view of part of the tent structure.

Stop means is provided for limiting the pivotal movement of each end region from its collapsed condition into the supporting condition. For each end region of the portion 36 of the support frame, this stop means comprises a U-shaped channel member 50 (see FIG. 5 particularly). The pivoted end of each of the arms 38 is received within its associated U-shaped section 50 and a pivotal pin 52 passes through the legs of the U-shaped bracket and into a panel 34 at position 44. As may be seen from FIG. 5, each arm 38 is received snugly within its bracket 50. The arm pivots between a position in which it extends directly outwardly from the bracket in the collapsed condition of the first portion of the support frame (FIGS. 3 and 5) to a second position in which it extends along the bracket (FIG. 4). Each arm 38 moves into its second position as the first portion of the support frame moves into the supporting condition of FIG. 4, i.e. until each arm 38 contacts a base 54 of the U-shaped bracket thereby preventing further pivotal movement of the arm 38 in the same direction. In the supporting condition, spring-urged, manually depressible locating studs 56 in the tube 48 enter into holes formed in the arms 42 for holding the first portion 36 of the frame in the supporting condition (FIG. 6), subject to manual release.

Figure 8:
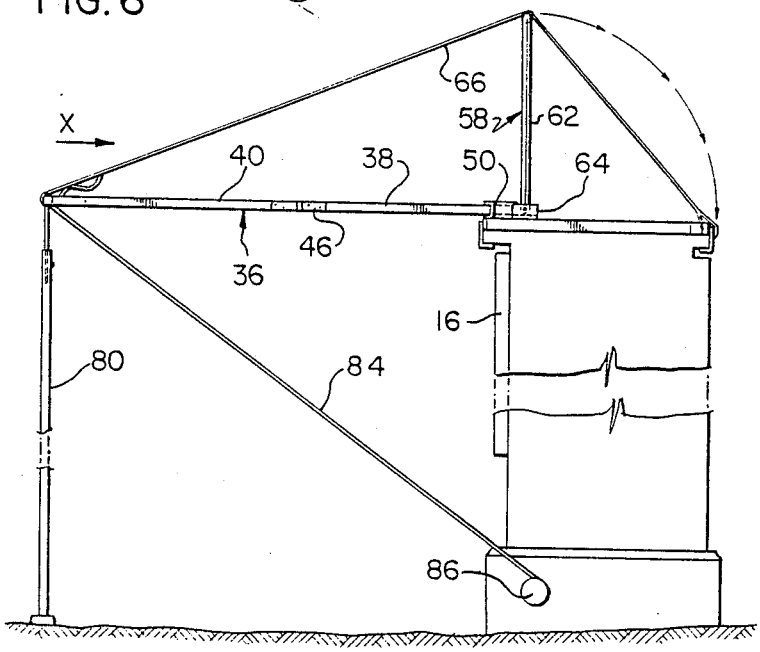
FIG. 8 is a view similar to FIG. 7 and showing the tent structure in a tent shroud supporting condition.
Figure 10:
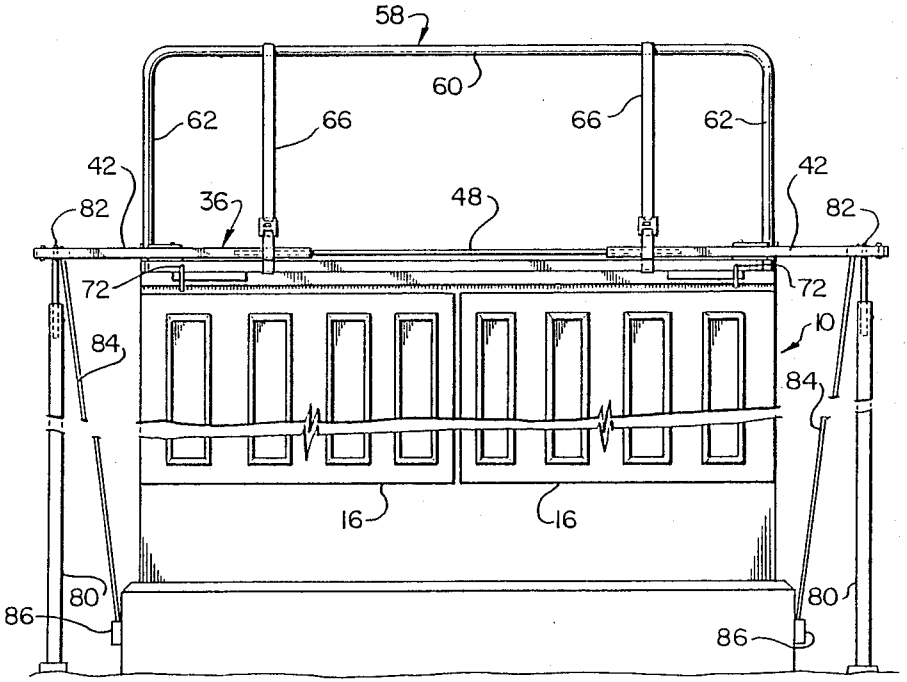
FIG. 10 is a view in the direction of arrow X in FIG. 7 of the tent structure.

The support frame also includes a second portion which comprises a U-shaped tube 58 having a base 60 and two legs 62 (FIGS. 3, 4, 8 and 10). The tube 58 extends along the length of the base frame 24 with the base 60 of a corresponding length, and the legs are pivotally connected at their free ends to the base frame at U-shaped brackets 64 disposed at the ends 30 of the base frame. The arrangement is such that the tube 58 is movable between a collapsed condition in which it overlies an edge region of the base frame, as shown in FIG. 3, and a tent shroud supporting condition in which it is moved outwardly to extend substantially normal to the plane of the base frame. This provides height to the structure as is shown in FIGS. 4, 8 and 10.

From the above description it will be realized that the base frame is a rigid uncollapsible structure and the first and second portions of the support frame lie within the confines of the base frame in plan view in the collapsed condition of the support frame. This can be seen from FIG. 3 and also from FIG. 7 which is an end view of the tent structure. Thus the overall plan area of the tent structure is not increased beyond that of the base frame in the collapsed condition and, with the first and second portions of the support frame lying on one side of the base frame, then the whole of the structure is substantially planar in its collapsed condition so as to be not unduly bulky.

The tent structure is also provided with a means to hold the second portion of the support frame in its supporting condition when the first portion is also in its supporting condition. This particular means comprises at least one flexible strap, and in this case, two flexible straps 66. Each flexible strap 66 is secured at one end to the inner end of an associated arm 42 and extends from there to the base 60 of the tube 58 to which it is also secured. Each strap then extends beyond the tube 58 and the other end of the strap is secured to the tube 26 of the base frame on the side 32 remote from the arms 42. This is clearly shown in FIGS. 4 and 8. As shown by FIG. 8, the strap is in a substantially taut condition in the supporting condition of the support frame so as to hold the tube 58 in its position extending vertically above the base frame. The strap is also useful during expansion of the support frame from the collapsed condition in that movement of the arms 38, 40 and 42 outwardly from the base frame tends to cause the tube 58 to be pivoted upwardly into its support position by the pulling action of the strap.

Figure 9:
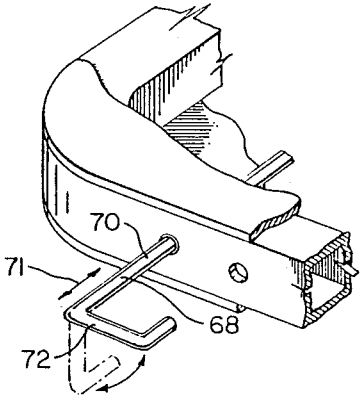
FIG. 9 is an isometric view of part of the tent structure showing of a securing means.

As an essential feature of this invention and of this embodiment, the tent structure has a means by which the base frame may be secured to the free-standing equipment. This means comprises a securing means provided by a plurality, namely four, rods 68 (FIG. 4). Each rod has a generally straight portion 70 and a hooked end 72. The rods are disposed, two towards each end of the base frame, so as to lie between the plates 34. Each rod passes through aligned holes in the tubes 26 and 28 with the rods extending laterally of the base frame in opposite directions so that their hooked ends 72 lie outside the tubes 26 as shown by FIG. 4. The rods 68 are movable axially of their straight portion 70 between retracted positions shown in FIG. 4 and extended positions, shown in chain-dotted outline in FIG. 4 for two of the rods, in which the hooked ends are spaced from the frame. The rods are resiliently urged into their retracted positions to bring the hooked ends close to the base frame 26, by compression springs 74 surrounding the inner ends of the rods and acting against the tube 28 of the base frame. This movement between retracted and extended positions is shown by the arrow 71 in FIG. 9. FIG. 9 shows an extended position. In addition, the rods are pivotal about the axes of their main portions 70 to change the angular positions of their hooked ends between the full outline and the chain-dotted position shown by FIG. 9.

In use of the tent structure, it is to be secured to the top 18 of the cabinet 10 described above. As can be seen in the side elevational view in FIG. 7, the cabinet 10 has a longitudinally extending undercut 78 below its top on the rear face of the cabinet, this undercut corresponding to the overhang 80 of the top over the doors at the front of the cabinet.

Figure 7:
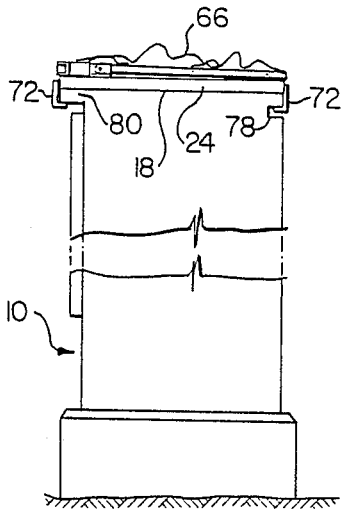
FIG. 7 is a side elevational view of free-standing telecommunications equipment having the tent structure of the embodiment secured upon it in its collapsed condition and taken in the direction of arrow VII in FIG. 3.

The tent structure is assembled onto the top of the cabinet in its collapsed condition and the structure is then extended to the tent shroud supporting condition before the tent shroud is assembled onto the structure. Thus, with the tent structure in the collapsed condition shown by FIG. 3, it is located on the top 18 of the cabinet with the base frame 24 lying against the top surface of the cabinet (FIG. 7). The rods 68 are then pulled out to their extended positions in turn, are rotated to bring their hooked ends 72 into the chain-dotted position shown in FIG. 9 and are released. The compression springs 74 then draw the rods back towards their retracted positions so as to engage the hooked ends around the top 18 of the cabinet with ends of the hooks located within the recess at the back of the cabinet and also underneath the overhang 80 formed by the top as shown in FIG. 7. The base frame and thus the tent structure is then securely mounted upon the cabinet and the weight of the structure is no longer taken by the person who will extend the structure. The support frame is then extended into its supporting condition in which the arms 38 to 42 and tube 48 move outwardly substantially in the plane of the tent structure to cover the work area in the front of the doors of the cabinet. This stage is shown by FIG. 8. This movement extends the flexible strap 66 and the tube 58 is raised into the final position shown by FIG. 8. In the shroud supporting condition, while it is not strictly necessary to provide further support for the structure, corner poles 80 may in fact be used as shown by FIGS. 8 and 10 to provide support for the first portion 36 of the support frame and also to form corner poles for the tent shroud to be positioned upon the structure. These poles 80 may be adjustable in length and have upper end location pins 82 extending axially for location in positioning holes in the arms 42. In addition, stabilizing ropes 84 are positioned to extend from the region of the pivotal connection between the arms 40 and 42 at each side down to an anchor block 86 at the lower end of each side of the cabinet.

A tent shroud 88 is then placed over the structure (FIGS. 11 and 12). This tent shroud has a top 90 correspondingly shaped to lie over the tube 58 and extend in contact with the sloping tensioned strap 66 towards the back of the base frame and also over the arms 38, 40, 42 and tube 48. The tent also has sides 92 and a front and a back 94 and 96 which extend down to the ground so as to completely enshroud the cabinet and the work area in front of it which is overshadowed by the support frame. Conveniently, and for access beneath the tent, the front is provided by two flaps with access provided by a central zip fastener 98 between the flaps and two side zips 100 which connect the flaps to the sides 92 of the shroud.

As can be seen from the above description, the assembly of the tent around the cabinet is an operation which is simply performed by one person. The tent structure in its collapsed condition in this particular embodiment is approximately 153 cm long and 63 cm wide. It is a relatively simple matter for a structure of these dimensions to be lifted onto the electrical equipment which is approximately 175 cm high. After the base frame is secured in position by the rods 68, then the engineer may expand the support frame without having to contend with the weight of the total tent structure and such a maneuver may easily be performed even under windy conditions. The location of the tent shroud over the tent frame under windy conditions is also a simpler operation than the lifting of a completed prior art tent including its support structure over the electrical equipment.

To avoid the necessity of having to locate the tent shroud in position on windy occasions, it is possible to have the tent structure in a collapsed condition with the tent shroud folded into and around the structure. This arrangement is shown by FIG. 13 in which folded parts of the tent shroud 88 lie around the tent structure and above the base. It has been found that the tent structure assembled with the shroud may still be easily carried and lifted onto the cabinet by one person. The folded tent shroud is easily held up onto the collapsed frame by the use of straps (not shown) encircling the total assembly. The structure may be expanded into the tent supporting condition shown in FIG. 4 even in the presence of the tent shroud itself. Of course when the tent shroud is assembled to the structure in this way, then the problems associated with wind resistance are minimized because the shroud does not need to be separately assembled onto the extended structure.

In the above embodiment, the rods 68 provide means by which the tent structure may be secured to the free-standing equipment. It should be realized, however, that the securing means design is dependent to a large degree on the design of the equipment, i.e. the cabinet. Thus, other cabinet designs not provided with the top overhang 80 and undercut 78 will require the use of other designs of securing means upon the tent structure. Alternative designs of securing means may include screw-threaded arrangements and clamps assembled onto the base frame instead of the rods 68, these alternative designs, of course, being compatible with the equipment to which the tent structure is to be assembled.

What is claimed is:

1. A tent structure for covering free-standing equipment and an adjacent work area, the structure comprising:

(a) a substantially planar base frame having means by which it may be secured in a substantially horizontal plane to the free-standing equipment;

(b) a tent shroud support frame having a first collapsible portion and a second collapsible portion, each portion movable between a collapsed condition on the base frame and an extended tent shroud supporting condition in which the first collapsible portion extends horizontally beyond the boundary of the base frame and the second collapsible portion extends upwardly beyond the base frame to provide height to the structure, and wherein the first collapsible portion has two end regions and san intermediate region extending between the end regions and lying in telescoping relationship therewith, each end region comprising a plurality of support arms which are pivotally connected together in series, remote ends of the support arms providing ends of the first portion and being pivotally connected to the base frame; and (c) flexible strap means extending between and secured to the first and second collapsible portions, said strap means being slack in the collapsed condition of the support frame and being caused to extend to a taut condition as the first collapsible portion is being moved to its extended condition so as to pull upon the second collapsible portion and cause it to move into an extended condition simultaneously with the movement of the first collapsible portion into its extended condition.

2. A tent structure according to claim 1 wherein:

(a) in the collapsed condition, the first portion lies substantially within the confines of the base frame in a plan view taken onto the plane of the base frame with the support arms of each end region pivoted into positions in which they lie side-by-side at said one side of the base frame, and the intermediate region extends along said one side of the base frame and is telescopically collapsed in relation to support arms of the end regions which lie adjacent to the intermediate region; and (b) in the supporting condition, the arms of each end region extend outwardly beyond the boundary of the base frame with the two end regions spaced apart from one another, said support arms which lie adjacent the intermediate region extending towards one another with the intermediate region and said adjacent support arms in telescopically expanded relationship.

3. A tent structure according to claim 2 wherein the second portion of the support frame is generally of U-shaped configuration having a base and two laterally spaced legs, each leg having a free end pivotally connected to the base frame to enable the second portion of the support frame to pivotally move between its collapsed and supporting conditions.

4. A tent structure according to claim 3 wherein the means by which the base frame may be secured to the free-standing equipment comprises a plurality of rods mounted within and at opposite sides of the base frame and having hooked ends exteriorly of the base frame, the rods slidably movable along their axes between retracted positions in which the hooked ends lie close to the base frame and extended positions in which the hooked ends are spaced from the base frame and with the rods slidable to extended positions at one side of the base frame in a direction opposite from that of the rods at the other side of the base frame, the rods also being rotatable about their axes and being resiliently urged axially into their retracted positions.

5. A tent structure according to claim 1 having stop means secured to the base frame and associated with each end region of the first portion of the support frame to limit pivotal movement of the arms away from the collapsed condition and into the supporting condition.

6. A tent structure according to claim 1 wherein the means by which the base frame may be secured to the free-standing equipment comprises a plurality of rods mounted within and at opposite sides of the base frame and having hooked ends exteriorly of the base frame, the rods slidably movable along their axes between retracted positions in which the hooked ends lie close to the base frame and extended positions in which the hooked ends are spaced from the base frame and with the rods slidable to extended positions at one side of the base frame in a direction opposite from that of the rods at the other side of the base frame, the rods also being rotatable about their axes and being resiliently urged axially into their retracted positions.

7. A tent structure for covering free-standing equipment and an adjacent work area, the structure comprising:

(a) a substantially planar base frame having means by which it may be secured in a substantially horizontal plane to the free-standing equipment, said securing means comprising a plurality of rods mounted within and at opposite sides of the base frame and having hooked ends exteriorly of the base frame, the rods slidably movable along their axes between retracted positions in which the hooked ends lie close to the base frame and extended positions in which the hooked ends are spaced from the base frame with the rods slidable to extended positions at one side of the base frame in a direction opposite from that of the rods at the other side of the frame, the rods also being rotatable about their axes and being resiliently urged axially into their retracted positions;

(b) a tent shroud support frame having a first collapsible portion and a second collapsible portion, each portion movable between a collapsed condition on the base frame and an extended tent shroud supporting condition in which the first collapsible portion extends horizontally beyond the boundary of the base frame and the second collapsible portion extends upwardly beyond the base frame to provide height to the structure; and (c) flexible strap means extending between and secured to the first and second collapsible portions, said strap means being slack in the collapsed condition of the support frame and being caused to extend to a taut condition as the first collapsible portion is being moved to its extended condition so as to pull upon the second collapsible portion and cause it to move into its extended condition simultaneously with the movement of the first collapsible portion into its extended condition.

* * * * *

UNITED STATES PATENT AND TRADEMARK OFFICE

CERTIFICATE OF CORRECTION

PATENT NO. : 4,834,129

DATED : May 30, 1989

INVENTOR(S) : Jean P. Pinsonneault

It is certified that error appears in the above-identified patent and that said Letters Patent is hereby corrected as shown below:

On the title page, "[73] Assignee: Northern Telecom Limited, Montreal, Canada" should be --[73] Assignee: BELL CANADA, Montreal, Canada--.

Signed and Sealed this

Twenty-fourth Day of July, 1990

*Attest:*

HARRY F. MANBECK, JR.

*Attesting Officer*

*Commissioner of Patents and Trademarks*